US006874473B2

(12) United States Patent
Carpenter

(10) Patent No.: US 6,874,473 B2
(45) Date of Patent: Apr. 5, 2005

(54) ENGINE CYCLE RECOGNITION FOR FUEL DELIVERY

(75) Inventor: Todd L. Carpenter, Gregory, MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/891,993

(22) Filed: Jul. 15, 2004

(65) Prior Publication Data

US 2005/0038594 A1 Feb. 17, 2005

Related U.S. Application Data

(60) Provisional application No. 60/495,162, filed on Aug. 14, 2003, and provisional application No. 60/494,136, filed on Aug. 11, 2003.

(51) Int. Cl.[7] ..... F02P 5/00

(52) U.S. Cl. ..... 123/406.18; 123/406.58

(58) Field of Search ..... 123/319, 406.12, 123/406.13, 406.18, 406.58; 73/118.1, 116

(56) References Cited

U.S. PATENT DOCUMENTS

| | | | | |
|---|---|---|---|---|
| 4,123,935 A | | 11/1978 | Maringer | 73/116 |
| 4,407,155 A | * | 10/1983 | Sundeen | 73/116 |
| 4,870,587 A | | 9/1989 | Kumagai | 364/431.07 |
| 5,445,014 A | | 8/1995 | Fiorenza, II et al. | 73/117.3 |
| 5,988,140 A | | 11/1999 | Gartner et al. | 123/406.24 |
| 6,170,465 B1 | | 1/2001 | Shomura | 123/436 |
| 6,234,145 B1 | | 5/2001 | Shomura | 123/406.24 |
| 6,273,065 B1 | | 8/2001 | Carpenter | 123/436 |
| 6,457,465 B2 | | 10/2002 | Lee | 123/643 |
| 6,499,341 B1 | | 12/2002 | Lodise et al. | 73/117.3 |
| 2002/0179058 A1 | | 12/2002 | Hirano et al. | 123/475 |

FOREIGN PATENT DOCUMENTS

| | | |
|---|---|---|
| EP | 0 704 621 B1 | 1/2004 |

* cited by examiner

*Primary Examiner*—Bibhu Mohanty
(74) *Attorney, Agent, or Firm*—Baker & Daniels

(57) ABSTRACT

Piston stroke recognition methods for small internal combustion engines, such as single and two cylinder engines, in which the ignition-related trigger pulses corresponding to the engine cylinders are the only input signal used for stroke recognition.

20 Claims, 5 Drawing Sheets

ENGINE CYCLE RECOGNITION FOR FUEL DELIVERY

CROSS REFERENCE TO RELATED APPLICATIONS

This application claims the benefit under Title 35, U.S.C. § 119(e) of U.S. Provisional Patent Application Ser. No. 60/494,136, entitled ENGINE CYCLE RECOGNITION FOR FUEL DELIVERY, filed on Aug. 11, 2003, as well as U.S. Provisional Patent Application Ser. No. 60/495,162, entitled ENGINE CYCLE RECOGNITION FOR FUEL DELIVERY, filed on Aug. 14, 2003.

BACKGROUND OF THE INVENTION

1. Field of the Invention

The present invention relates to small internal combustion engines of the type used with lawnmowers, lawn and garden tractors, other small implements, or in sport vehicles, for example. In particular, the present invention relates to determining engine cycle recognition, or piston stroke recognition, in such engines for fuel delivery by a fuel injection system.

2. Description of the Related Art

Small internal combustion engines, such as single or two cylinder engines, are supplied with a fuel/air mixture for combustion via either a carburetor or by a fuel injection system in a conventional four cycle operation, including the piston strokes of intake, compression, power, and exhaust. In small engines which include a fuel injection system, it is important to determine the phase or stroke of the cylinder piston(s) in order to ensure that fuel is injected into the cylinders at the optimum point during the intake stroke of the piston(s).

In many known systems for determining piston stroke recognition, electronic sensors are used to sense the position of the engine crankshaft and/or camshaft. Signals generated from these sensors are used to coordinate the position and speed of the crankshaft or camshaft with the position of one or more pistons to determine when to inject fuel into the engine cylinders. Disadvantageously, these systems require separate sensors to be mounted to the engine, which tends to increase the overall cost and complexity of the fuel injection systems for small internal combustion engines.

Additionally, some small engines may experience high inertial loads during running, such as engines which drive a high inertia implement through a belt drive, for example. In these engines, it has been found that the inertia of the driven implement and the elasticity of the belt, for example, may impose a strong load on the engine crankshaft. At certain times during running the engine, this imposed load primarily determines the crankshaft speed, rather than the actual firing of the engine cylinders. Under these circumstances, piston stroke recognition methods which are dependent upon sensing crankshaft or camshaft speed may be prone to failure.

What is needed are piston stroke recognition methods for small internal combustion engines which are an improvement over the foregoing.

SUMMARY OF THE INVENTION

The present invention provides piston stroke recognition methods for small internal combustion engines, such as single and two cylinder engines, in which the ignition-related trigger pulses corresponding to the engine cylinders are the only input signal used for stroke recognition. In a first method, the time periods of a plurality of crankshaft revolutions are measured upon engine start-up, from which an average engine speed is obtained. For an exemplary V-twin engine having its cylinders spaced 90° from one another, a time period and corresponding crankshaft speed is also determined between the successive ignition-related trigger pulses of the second and first cylinders, which encompasses 270° of crankshaft revolution. This speed is compared to the average engine speed to determine the stroke or phase of each cylinder.

As an enhancement to the foregoing first method, two running averages of odd and even periods of crankshaft revolution are measured, from which average crankshaft speeds are calculated. By comparing one or both of these two running averages with the average engine speed, stroke recognition can be determined accurately even if variations are present in the average engine speed, for example, if a strong load is imposed from time to time on the engine, such as by a high inertia driven implement, for example. In this manner, the foregoing first method filters or removes inertial load effects on the engine which could potentially lead to inaccurate stroke recognition.

In a second, different method, with reference to an exemplary V-twin engine, a first time period between successive ignition-related trigger pulses for one of the cylinders is measured upon engine start-up, which corresponds to a first crankshaft revolution. Thereafter, a second time period between successive ignition-related trigger pulses for the cylinder is measured, which corresponds to a second, subsequent crankshaft revolution. These two time periods, which have different durations, are then compared with one another to determine the stroke or phase of the piston for that cylinder. In a two cylinder engine, once the stroke or phase of the piston for the one cylinder is determined, the stroke or phase of the piston for the other cylinder is known or readily determined from the known engine timing.

Further, each of the foregoing methods is also operable for determining piston stroke recognition in a single cylinder engine.

Advantageously, each of the present methods allows the determination of the stroke of one or more pistons in an engine using only the ignition-related trigger pulses of the engine's ignition system, corresponding to the engine cylinders, as the only input signal for stroke recognition. Thus, the need for complex and expensive crankshaft and/or camshaft position sensors is obviated. In this manner, the present methods are readily and economically suitable for small internal combustion engines.

In one form thereof, the present invention provides, in an internal combustion engine including a crankshaft and at least one cylinder having a piston reciprocating therein according to a four-stroke cycle of intake, compression, power, and exhaust, a method for determining the stroke of a piston, including the steps of generating an ignition-related event for each cylinder during each revolution of the crankshaft; obtaining an average engine speed; determining the duration of a plurality of periods between successive ignition-related events, each period corresponding to at least a portion of at least one of an even and odd crankshaft revolution; obtaining an average duration for the plurality of periods; and determining the stroke of a piston by comparing the average duration for the plurality of periods to the average engine speed.

In another form thereof, the present invention provides, in an internal combustion engine including a crankshaft and a pair of cylinders arranged X° from one another, each cylinder including a piston reciprocating therein according to a four-stroke cycle of intake, compression, power, and exhaust, a method for determining the stroke of a piston, including the steps of generating an ignition-related event for each cylinder during each crankshaft revolution; obtaining an average engine speed; determining the duration of at least one (360°–X°) period between successive ignition-related events of the engine cylinders; and determining the stroke of a piston by comparing the duration of the (360°–X°) period to the average engine speed.

In a further form thereof, the present invention provides, in an internal combustion engine including a crankshaft and a pair of cylinders arranged substantially X° from one another, each cylinder including a piston reciprocating therein according to a four-stroke cycle of intake, compression, power, and exhaust, a method for determining the stroke of a piston, including the steps of generating an ignition-related event for each cylinder during each crankshaft rotation; determining the durations of a plurality of 360° periods between successive ignition-related events of one of the cylinders; obtaining an average engine speed from the durations of the 360° periods; determining the durations of even and odd (360°–X°) periods between successive ignition-related events of the engine cylinders; obtaining average speeds from the durations of the even and odd (360°–X°) periods; and determining the stroke of a piston by comparing the average speed from the even and odd (360°–X°) periods to the average engine speed.

Another, different method, the present invention provides, in an internal combustion engine including a crankshaft and a pair of cylinders arranged at an angle with respect to one another, each cylinder including a piston reciprocating therein according to a four-stroke cycle of intake, compression, power, and exhaust, a method for determining the stroke of a piston, including the steps of: generating an ignition-related event for each of the cylinders during each crankshaft revolution; determining the durations of a plurality of first periods between successive ignition-related events of one of the engine cylinders corresponding to odd crankshaft revolutions; obtaining an average duration for the plurality of first periods; determining the durations of a plurality of second periods between successive ignition-related events of the one engine cylinder corresponding to even crankshaft revolutions; obtaining an average duration for the plurality of second periods; and comparing the average duration for the plurality of first periods with the average duration for the plurality of second periods.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the inventions, and such exemplifications are not to be construed as limiting the scope of the inventions any manner.

DETAILED DESCRIPTION

Figure 1:
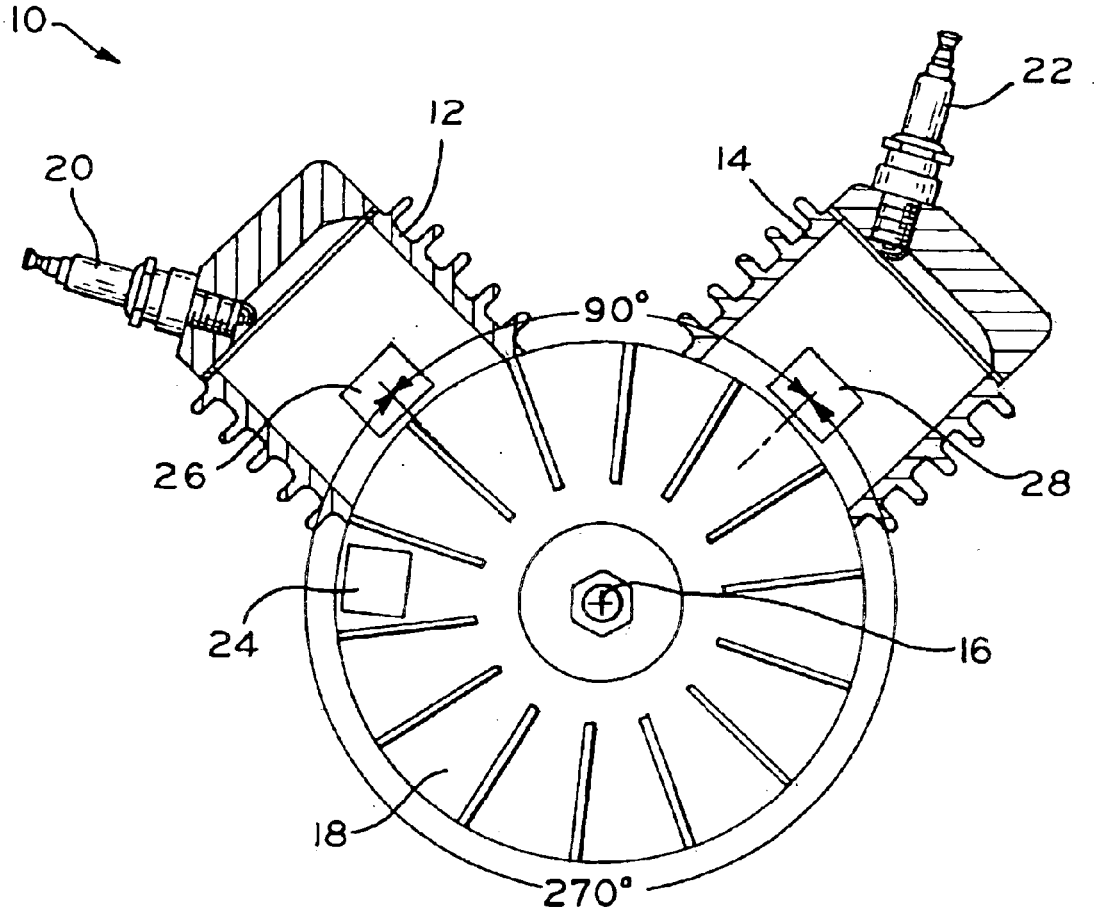
FIG. 1 is a schematic view of portions of an exemplary two cylinder, V-twin engine, including first and second cylinders, a crankshaft, and a flywheel.

In FIG. 1, a two cylinder engine 10 is shown herein as a V-twin engine, including first cylinder 12 and second cylinder 14 arranged 90° apart from one another. Although first and second cylinders 12 and 14 are shown arranged 90° apart from one another, as is common in most V-twin engines, the angular spacing therebetween may vary. Engine 10 is a four cycle engine, in which each cylinder 12 and 14 includes a piston (not shown) which operates on the conventional cycles of intake, compression, power, and exhaust. First cylinder 12 and second cylinder 14 are each connected to a crankcase (not shown) which includes crankshaft 16 rotatably mounted therein. Crankshaft 16 may be disposed horizontally or vertically. Flywheel 18 is mounted to one end of the crankshaft 16, and includes a plurality of fins for conducting cooling air about cylinders 12 and 14 during running of engine 10.

First and second cylinders 12 and 14 include first and second spark plugs 20 and 22, respectively. Flywheel 18 includes permanent magnet 24, and first and second cylinders 12 and 14 include first and second trigger coils 26 and 28 electrically connected to first and second spark plugs 20 and 22, respectively. Trigger coils 26 and 28 are disposed on or proximate first and second cylinders 12 and 14, respectively, and are also disposed closely proximate magnet 24, which passes close to trigger coils 26 and 28 as flywheel 18 rotates during running of engine 10.

Generally, engine 10 operates according to a capacitive discharge-type ignition system, in which magnet 24 generates electrical pulses as it rotates past a charge coil (not shown) and trigger coils 26 and 28. These coils are positioned such that when magnet 24 passes the charge coil, a charge pulse is generated which charges a capacitor (not shown) during the compression stroke of each cylinder 12 and 14. When magnet 24 passes each trigger coil 26 and 28, a trigger pulse is generated which discharges the capacitor and fires spark plugs 20 and 22, respectively, near the top of the compression stroke for each cylinder 12 and 14, thereby igniting the compressed fuel/air mixture in each cylinder 12 and 14 to drive engine 10. Further details regarding this type of capacitive discharge ignition system are set forth in U.S. Pat. No. 6,273,065, assigned to the assignee of the present invention, the disclosure of which is incorporated herein by reference.

As discussed below, even though the first and second stroke recognition methods operate differently, the first and second stroke recognition methods each use an ignition-related event as the only input signal for sensing engine timing and determining piston stroke recognition. This ignition-related event may be the foregoing ignition-related trigger pulses of the engine cylinders, such as the trigger pulses of spark plugs 20 and 22, but could also be any other ignition-related pulse or voltage change produced by the electronic ignition system of engine 10. Advantageously, sensors associated with crankshaft 16 or the camshaft of engine 10, such as optical or variable reluctance sensors, which measure the speed and/or position of the crankshaft or camshaft, are not needed with the present methods.

Figure 2:
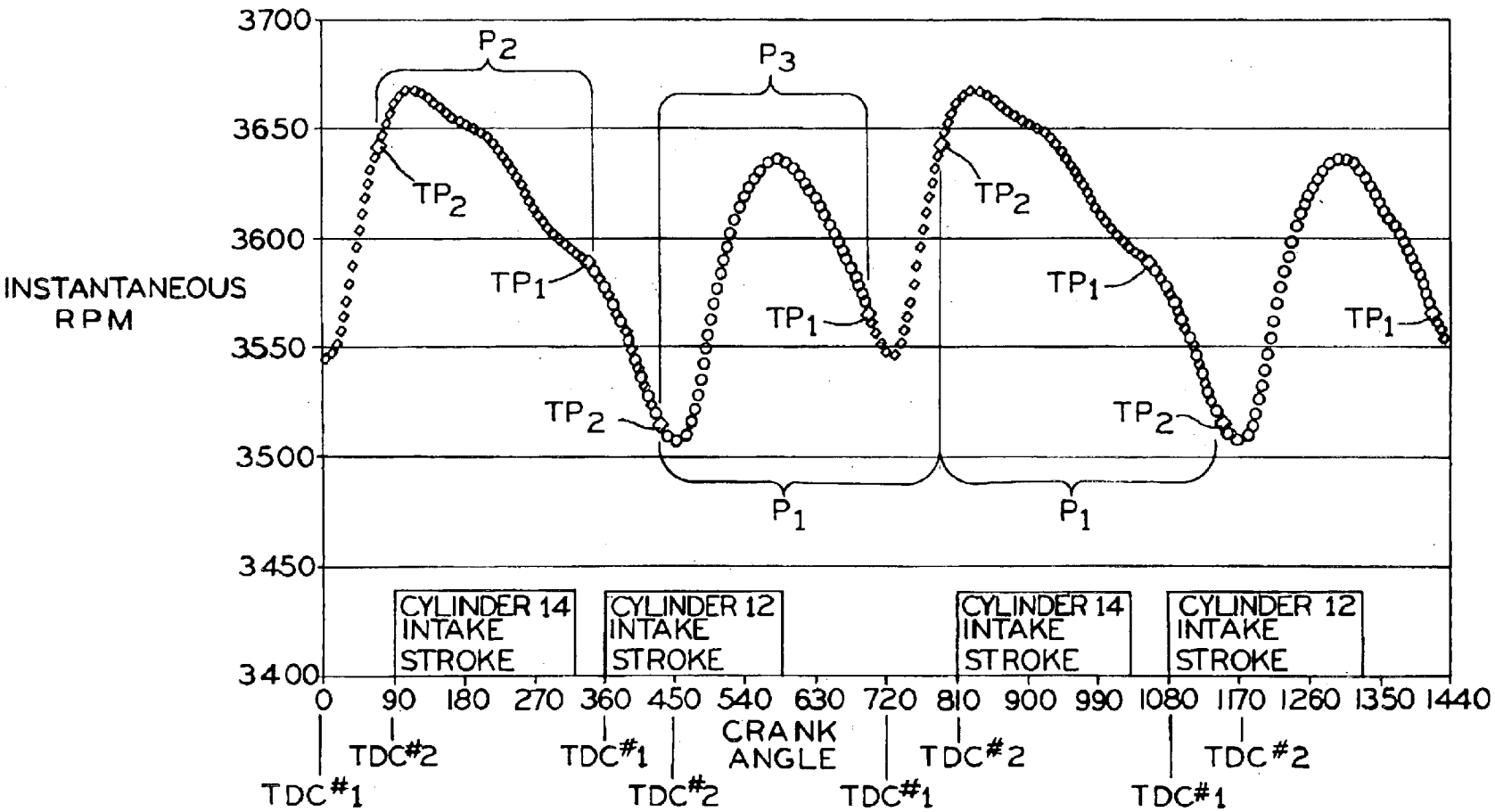
FIG. 2 is a chart of crank angle versus instantaneous rpm for the engine of FIG. 1, illustrating a stroke recognition methodology according to a first method.
Figure 3:
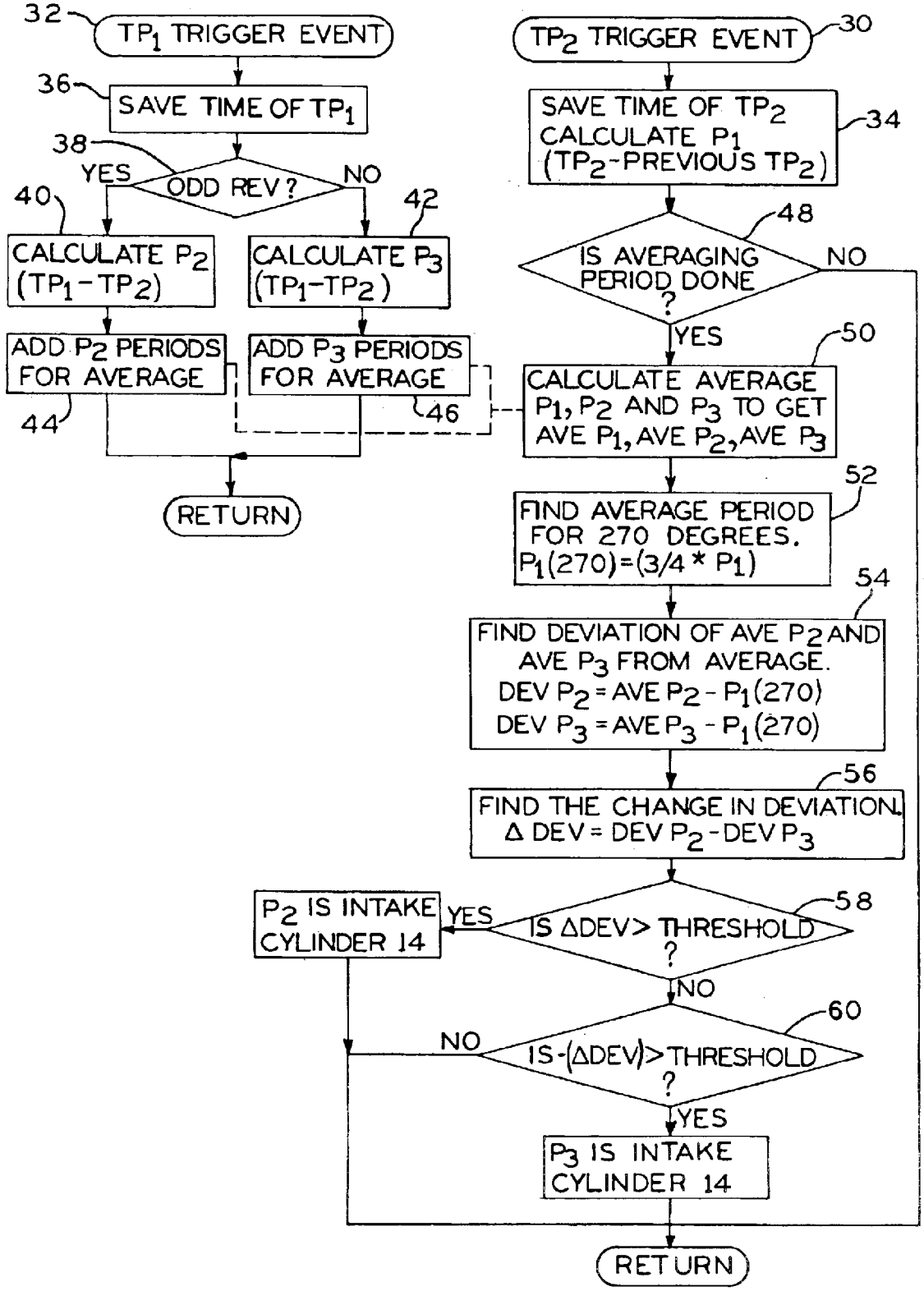
FIG. 3 is a flow chart illustrating the steps in the first method of stroke recognition, with reference to the engine events depicted in FIG. 2.

With reference to FIGS. 2 and 3, a first method of determining stroke recognition will be described.

In FIG. 2, instantaneous rpm for crankshaft 16 of engine 10 is plotted against the crank angle of crankshaft 16 for two complete cycles of engine 10, in which crankshaft 16 rotates through four revolutions, or 1440 degrees. The crank angles at which the pistons of first cylinder 12 and second cylinder 14 are at their top dead center ("TDC") positions are designated "TDC 1" and "TDC 2", respectively. The crank angles during which the pistons of first and second cylinders 12 and 14 are in their intake strokes are also set forth in FIG. 2. Trigger pulses for first cylinder 12 are designated $TP_1$, and trigger pulses for second cylinder 14 are designated $TP_2$. Referring to FIGS. 1 and 2, it may be seen that in the exemplary engine 10, because first and second cylinders 12 and 14 are spaced 90° from one another, the crank angle between the trigger pulse $TP_1$ of first cylinder 12 and the following trigger pulse $TP_2$ of second cylinder 14 is 90°, while the crank angle between the trigger pulse $TP_2$ of second cylinder 14 and the following trigger pulse $TP_1$ of first cylinder 12 is 270°. However, as noted above, the spacing and corresponding crank angle between first cylinder 12 and second cylinder 14 may vary.

Notably, for each cylinder 12 and 14, the piston in the cylinder will be completing its compression stroke when the trigger pulse is generated on one particular crankshaft revolution, and the piston will be completing its exhaust stroke when the trigger pulse is generated on the preceding or subsequent crankshaft revolution. In order to determine when to inject fuel into each cylinder 12 and 14, it is necessary to determine the position of its piston such that fuel is only injected in each cylinder 12 and 14 during its intake stroke.

Upon engine startup, the trigger pulses of either one of the two engine cylinders 12 and 14 are used to calculate the time durations of a plurality of crankshaft revolutions. For example, as shown in FIG. 2, the time duration of a period $P_1$ is determined from successive trigger pulses $TP_2$ of second cylinder 14, with each period $P_1$ corresponding to one complete revolution of crankshaft 16. A plurality of these periods $P_1$ are measured, added to one another, and then divided by the total number of such measured periods $P_1$ to calculate an average crankshaft or engine speed in revolutions per minute ("rpm"). This average engine speed may be determined from a minimum of two periods $P_1$, but is preferably determined from a larger number of periods $P_1$ to thereby result in a more accurate determination. Also, although periods $P_1$ have been described above as being determined from the trigger pulses $TP_2$ of second cylinder 14, same could also be determined from the trigger pulses $TP_1$ of first cylinder 12 in the same manner.

Thereafter, a time period $P_2$ is determined between the successive trigger pulses $TP_2$ and $TP_1$ of second cylinder 14 and first cylinder 12, respectively, a period which encompasses 270° of crankshaft revolution in engine 10, in which first and second cylinders 12 and 14 are spaced 90° from one another. However, because the spacing between first and second cylinders 12 and 14 may vary, period $P_2$ may be more generally expressed as (360°−X°), where X° corresponds to the angular spacing between first and second cylinders 12 and 14. Once period $P_2$ is measured, a crankshaft speed is determined therefrom.

The crankshaft speed for the 270° portion of period $P_1$ which corresponds to period $P_2$ is calculated as ($\frac{3}{4}*P_1$) where ¾ is derived from 270° period being ¾ of the complete 360° crankshaft revolution. One period $P_2$, or an average of a number of periods $P_2$, is then compared with the foregoing calculated value for the average engine speed. Referring to FIG. 2, if the measured crankshaft speed for one or more periods $P_2$ is greater than the average speed, second cylinder 14 was in its intake stroke for those periods $P_2$. If, however, the measured crankshaft speed for one or more periods $P_2$ is lower than the average engine speed, second cylinder 14 was in its power stroke for those periods.

The deviation of each period $P_2$ from the average engine speed results from the fact that crankshaft 16 rotates slower than the average engine speed when one or both of cylinders 12 and 14 is in a gas exchange stroke, such as the intake and exhaust strokes. Crankshaft 16 rotates faster than the average engine speed when one or both of cylinders 12 and 14 is in its power stroke. Based upon the known timing of engine 10, once the stroke or phase of the piston of second cylinder 14 is determined, the stroke or phase of the piston of first cylinder 12 is also known. In this manner, the stroke of the pistons of both first and second cylinders 12 and 14 can be determined.

Notably, the period corresponding to the angular spacing X° between first cylinder 12 and second cylinder 14 may also be used in the above manner to determine the stroke of the piston of each cylinder. For example, in engine 10, the 90° period between the trigger pulse $TP_1$ of first cylinder 12 and the following trigger pulse $TP_2$ of second cylinder 14 may be used. However, it has been determined from experimentation that use of the above-described longer period $P_2$ (360°−X°), such as 270° between trigger pulses $TP_2$ and $TP_1$ for second and first cylinders 14 and 12 typically results in a more robust piston stroke determination.

The foregoing first method works well for V-twin engines which directly drive a low inertia implement, such as when a small blade is directly attached to crankshaft 16. In these types of engines, the inertial load from the driven implement on crankshaft 16 are typically low during running of engine 10, such that the average speed of engine 10 is relatively constant, and thereby serves as a good comparison point for discriminating the strokes of the pistons of the first and second cylinders 12 and 14.

However, in V-twin engines which drive high inertial loads, such as a high inertia implement through a belt drive, for example, it has been found that the inertia of the driven implement and/or the elasticity of the belt may impose a strong load on crankshaft 16. At certain times during running of engine 10, this strong, imposed load effects the engine speed. Under these circumstances, the calculated average engine speed is not constant, and the foregoing first method of cycle of recognition may be inaccurate.

In order to compensate for this phenomenon, the first piston stroke recognition method may be enhanced, as described below. In the enhanced methodology, the average crankshaft speed is calculated in the same manner as above.

However, in the enhancement of the first method, two running averages of "odd" and "even" periods $P_2$ are used. In other words, the time duration of every other period $P_2$ (i.e., the "odd" periods) are measured and an average crankshaft speed for those periods $P_2$ is calculated. At the same time, the other ("even") periods, shown in FIG. 2 as periods $P_3$, are measured and an average crankshaft speed for those periods $P_3$ is calculated. As discussed above, each of periods $P_2$ and $P_3$ may be expressed as (360°−X°).

By comparing one or both of these average crankshaft speeds for odd periods $P_2$ and even periods $P_3$ with the average engine speed, stroke recognition can be determined accurately even if a strong load is imposed from time to time on the engine by the implement and/or belt drive. In this manner, potential errors due to the implement inertia and belt elasticity effect are filtered out.

Referring to FIG. 3, the steps of an exemplary, enhanced version of the above-described first method are shown, with continued reference to the engine events which are depicted in FIG. 2 and described above with reference to engine 10 of FIG. 1. In the first method, the fuel injection system makes an arbitrary, initial assumption regarding the stroke or phase of each of the pistons in cylinders 12 and 14 upon engine startup, and injects fuel into cylinders 12 and 14 based on that initial assumption. This initial assumption for the stroke or phase of the pistons in the cylinders 12 and 14 may be either correct, in which the fuel injection system need not alter the timing of the fuel injection after the determination of piston stroke by the present method, or may be incorrect, in which the fuel injection system alters the timing of the fuel injection into cylinders 12 and 14 based upon the determination of the piston stroke.

In steps 30 and 32, $TP_2$ and $TP_1$ trigger events are detected, respectively, with the method initiated by a $TP_2$ trigger event. Optionally, the method may begin upon a detection of acceleration or deceleration of crankshaft 16 of engine 10. In step 34, the time of an initial $TP_2$ is saved, and an initial period $P_1$ is calculated from subtracting a second, subsequently detected $TP_2$ from the initial $TP_2$. In this manner, a number of periods $P_1$ may be calculated in step 34. Concurrently, in step 36, the time of an initial $TP_1$ following the initial $TP_2$ is saved, and an arbitrary determination is made in step 38 whether an odd or even revolution of crankshaft 16 of engine 10 is occurring. In subsequent steps 40 and 42, a number of odd and even periods $P_2$ and $P_3$ are calculated by subtracting detected $TP_1$ events from previously detected $TP_2$ events, and several such periods $P_2$ and $P_3$ are added to one another in steps 44 and 46.

In step 48, a determination is made whether a predetermined number of crankshaft revolutions, corresponding to a predetermined averaging period, has been completed for periods $P_1$, $P_2$, and $P_3$ by detecting from the total number of elapsed detected $TP_2$ (or optionally, $TP_1$) events. The number of crankshaft revolutions corresponding to the averaging period may vary as desired. Generally, the lesser number of crankshaft revolutions used for the averaging period allows the method to make a piston stroke recognition determination faster. However, the larger number of crankshaft revolutions used for the averaging period generally increases the accuracy of the method. One exemplary number of revolutions is 100, which provides 100 individual periods $P_1$ from which to obtain the average period $P_1$ ($AveP_1$), and 50 individual periods for each of periods $P_2$ and $P_3$ from which to obtain the average periods $P_2$ and $P_3$ ($AveP_2$ and $AveP_3$). In step 50, the averages of periods $P_1$, $P_2$, and $P_3$ are calculated by dividing each of totals for the added periods $P_1$, $P_2$, and $P_3$ by the number of predetermined crankshaft revolutions in the averaging period to obtain $AveP_1$, $AveP_2$, and $AveP_3$, respectively.

In step 52, the average engine speed over the 270° period between $TP_2$ and $TP_1$ is calculated as $P_1(270)=(3/4*AveP_1)$. In step 54, the deviations of $AveP_2$ and $AveP_3$ from the average engine speed over the 270° period between $TP_2$ and $TP_1$ are determined as $DevP_2$ and $DevP_3$, respectively, by subtraction of $AveP_2$ and $AveP_3$ from the foregoing average engine speed over the 270° period from $TP_2$ and $TP_1$.

In step 56, the change in deviation, ΔDev, is calculated by subtracting $DevP_3$ from $DevP_2$. In step 58, ΔDev is compared to a time threshold, which in the present method is 25 microseconds (μsec). However, the threshold may vary as desired. If ΔDev is greater than the threshold, then cylinder 14 was on its intake stroke in period $P_2$. If ΔDev is not greater than the threshold, a determination is made in step 60 whether negative ΔDev (−ΔDev) is greater than the threshold. If negative ΔDev (−ΔDev) is greater than the threshold, then cylinder 14 was on its intake stroke in period $P_3$. The foregoing determinations may be compared with the initial assumption to determine whether the initial assumption was correct, and thereby determine whether the timing of fuel injection into cylinders 12 and 14 of engine 10 need be modified.

In step 60, if negative ΔDev (−ΔDev) is not greater than the threshold, then the value obtained for ΔDev during running of the present method is considered not to deviate from the threshold enough for an accurate determination of stroke recognition to be made. In this instance, the timing of the injection of fuel into cylinders 12 and 14 of engine 10 continues to operate based upon the initial assumption, and the foregoing method repeats until ΔDev differs from the threshold to the extend that an accurate determination of stroke recognition can be made.

The foregoing first method may also be used to discriminate the stroke of the piston in a single cylinder engine, in which a single trigger pulse is generated for the cylinder during each crankshaft revolution. First, an average engine speed is determined from measuring a plurality of periods between successive trigger pulses, each period corresponding to one crankshaft revolution. Thereafter, one period between successive trigger pulses is measured, a crankshaft speed is determined therefrom, and this crankshaft speed is then compared to the average engine speed. If the crankshaft speed is less than the average engine speed, then the piston was in its intake stroke during that period. If the crankshaft speed is greater than the average engine speed, then the piston was in its power stroke during that period. Further, the average of a number of "odd" or "even" periods between trigger pulses may be compared to the average engine speed to filter out variations in engine speed based upon engine load or other factors.

Figure 4:
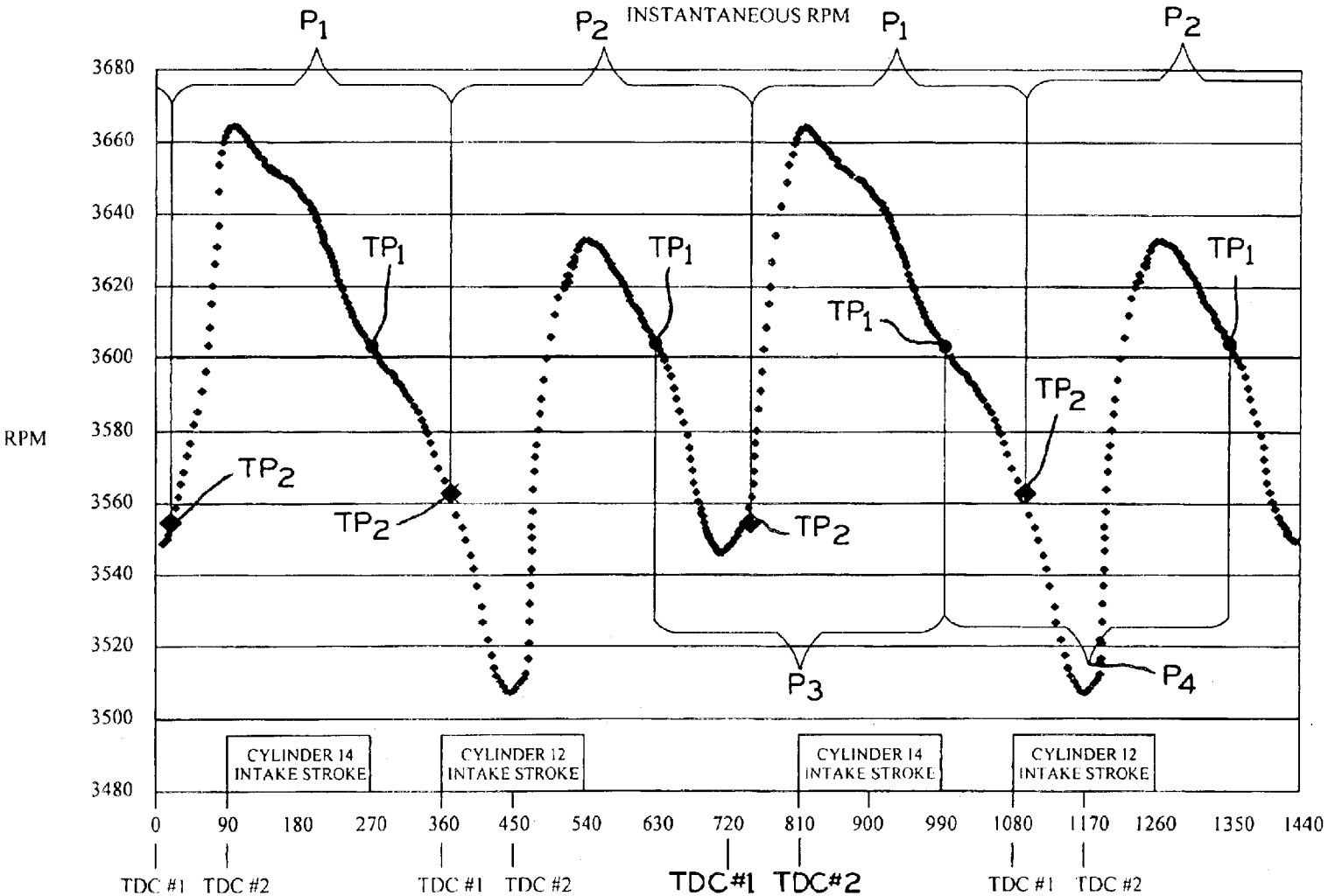
FIG. 4 is a chart of crank angle versus instantaneous rpm for engine of FIG. 1, illustrating a stroke recognition methodology according to a second method.
Figure 5:
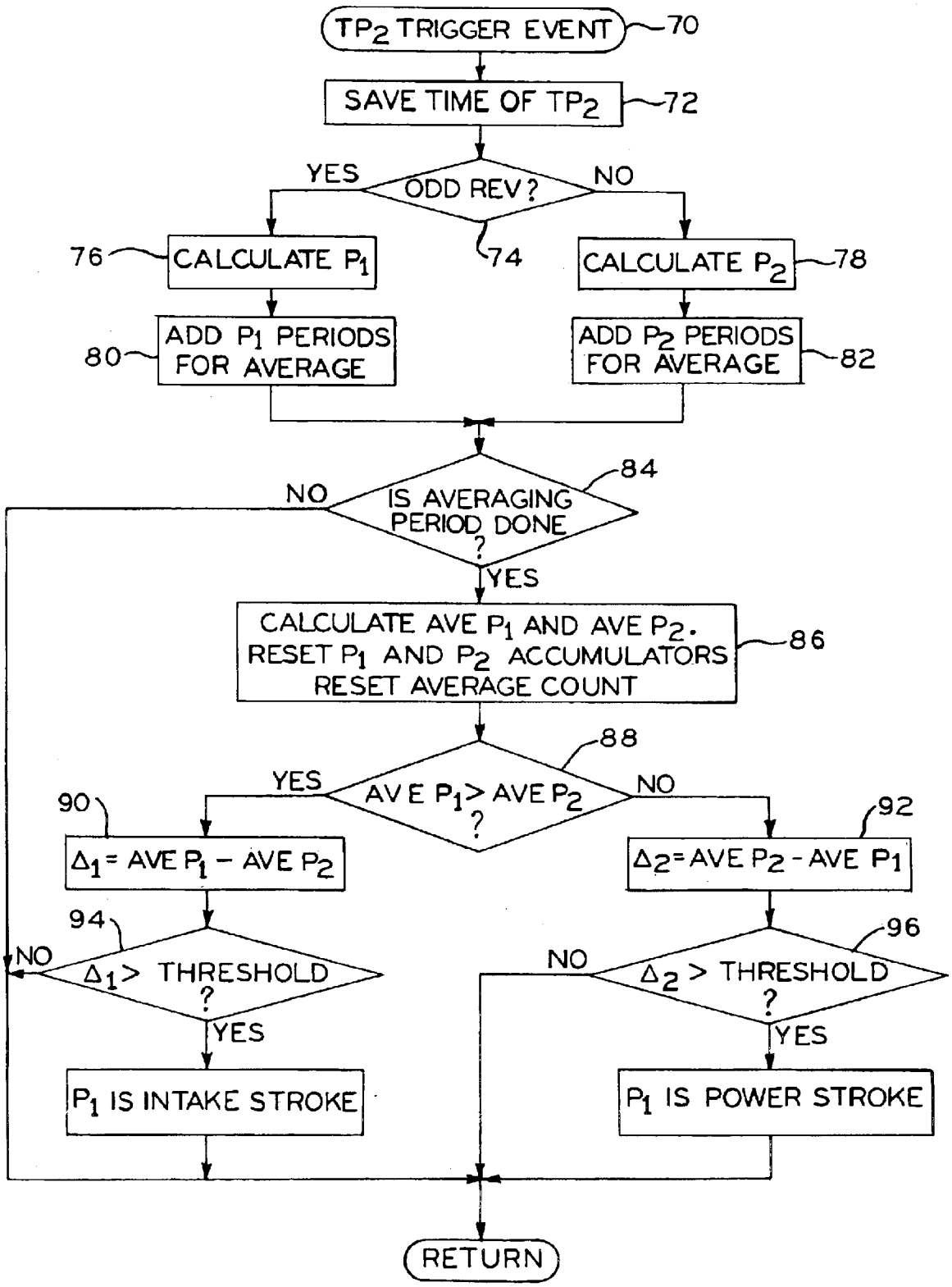
FIG. 5 is a flow chart illustrating the steps in the second method of stroke recognition, with reference to the engine events depicted in FIG. 4.

With reference to FIGS. 4 and 5, a second, different method of determining piston stroke recognition will be described.

In FIG. 4, instantaneous rpm for crankshaft 16 of engine 10 is plotted against the crank angle of crankshaft 16 for two complete cycles of engine 10, in which crankshaft 16 rotates through four complete revolutions, or 1440 degrees. The crank angles in which the pistons of first cylinder 12 and second cylinder 14 are at top dead center ("TDC") are designated "TDC 1" and "TDC 2", respectively. The crank angles during which the pistons of first and second cylinders 12 and 14 are in their intake strokes are also noted in FIG. 4. Trigger pulses for first cylinder 12 are designated $TP_1$, and trigger pulses for second cylinder 14 are designated $TP_2$. Referring to FIGS. 1 and 4, it may be seen that in the exemplary engine 10, because first and second cylinders 12 and 14 are spaced 90° from one another, the crank angle between the trigger pulse $TP_1$ of first cylinder 12 and the following trigger pulse $TP_2$ of second cylinder 14 is 90°, while the crank angle between the trigger pulse $TP_2$ of second cylinder 14 and the following trigger pulse $TP_1$ of first cylinder 12 is 270°. However, the angular spacing and corresponding crank angle between first cylinder 12 and second cylinder 14 may vary.

Notably, for each cylinder 12 and 14, the piston in the cylinder will be completing its compression stroke when the trigger pulse is generated on one particular crankshaft revolution, and the piston will be completing its exhaust stroke when the trigger pulse is generated on the preceding or subsequent crankshaft revolution. In order to determine when to inject fuel into each cylinder 12 and 14, it is necessary to determine the position of its piston such that fuel is only injected in each cylinder 12 and 14 during its intake stroke and not during its exhaust stroke.

Upon engine startup, the trigger pulses of either one of the two engine cylinders 12 and 14 are used to calculate the time durations of two or more successive crankshaft revolutions. For example, as shown in FIG. 4, the time duration of a period $P_1$ is determined from first and second successive trigger pulses $TP_2$ of second cylinder 14, which period $P_1$ corresponds to a first revolution of crankshaft 16. Thereafter, a second time period $P_2$ is determined from the second trigger pulse $TP_2$ of period $P_1$ to the next, subsequent trigger pulse $TP_2$, which period $P_2$ corresponds to a second, subsequent revolution of crankshaft 16.

As discussed further below, in V-twin engines such as engine 10, the durations of periods $P_1$ and $P_2$ are not equal, and may be compared to one another to determine the stroke or phase of the pistons of the engine cylinders. For the exemplary V-twin engine 10 having the timing shown in FIG. 4, the shorter of the periods $P_1$ and $P_2$ encompasses the intake stroke of the piston of second cylinder 14. Referring to FIG. 4, the duration of period $P_1$, which encompasses the intake stroke of the piston of second cylinder 14, is slightly less than the duration of period $P_2$, which encompasses the power stroke of the piston of second cylinder 12. In this manner, the shorter of the measured periods $P_1$ and $P_2$ will correspond to the intake stroke of the piston of second cylinder 14, and the longer of the periods $P_1$ and $P_2$ corresponds to the power stroke of the piston of second cylinder 14.

Once the stroke or phase of the piston of second cylinder 14 is determined in this manner, the stroke or phase of the piston of first cylinder 12 may be extrapolated from the known timing of engine 10. From this data, the fuel injection system of engine 10 is controlled to inject fuel into first and second cylinders 12 and 14 only during their respective intake strokes.

The difference in the duration of periods $P_1$ and $P_2$ is due the variation in the instantaneous speed of crankshaft 16 of engine 10. Referring to FIG. 4, it may be seen that each period $P_1$ follows the successive firing of second cylinder 14 and first cylinder 12, and encompasses the highest instantaneous speed of crankshaft 16, shown in FIG. 4 as just over 3660 rpm. Period $P_2$ encompasses the power stroke of second cylinder 14 but not the power stroke of first cylinder 12, and also encompasses the slowest instantaneous speed of crankshaft 16, shown in FIG. 4 as just above 3500 rpm. The average instantaneous speed of crankshaft 16 within period $P_1$ is higher than the average instantaneous speed of crankshaft 16 within period $P_2$, and therefore, the duration of period $P_1$ is shorter than the duration of period $P_2$. The foregoing variation in crankshaft speed between periods $P_1$ and $P_2$ will be present in any two cylinder engine in which the cylinders are angularly spaced from one another, wherein the cylinders do not fire at the same time or at 3600 crank angle from one another. Thus, the present method may be generally applied to any such "uneven firing" two cylinder engines, regardless of the particular angular spacing between the cylinders.

Alternatively, as shown in FIG. 4, time periods $P_3$ and $P_4$ can be measured using the ignition trigger pulses $TP_1$ of first cylinder 12 in a manner similar to the above to determine the stroke or phase of the pistons of first and second cylinders 12 and 14. In particular, period $P_3$, which encompasses the intake stroke of the piston of second cylinder 14, is shorter than period $P_4$, which encompasses the power stroke of the piston of second cylinder 14.

However, it has been determined from experiment that with respect to the exemplary engine 10, the difference between the durations of periods $P_1$ and $P_2$, measured using the ignition trigger pulses $TP_2$ of second cylinder 14, is greater than the difference between the durations of periods $P_3$ and $P_4$, measured using the ignition trigger pulses $TP_1$ of first cylinder 12. Due to the foregoing, comparing periods $P_1$ and $P_2$ typically yields a more robust determination of the stroke or phase of the pistons of first and second cylinders 12 and 14 than comparing periods $P_3$ and $P_4$.

The foregoing second method works well for V-twin engines which directly drive a low inertia implement, such as when a small blade is directly attached to crankshaft 16. In these types of engines, the inertial load from the driven implement on crankshaft 16 is low during running of engine 10, such that the average instantaneous speed of crankshaft 16 is relatively constant for each period $P_1$ and $P_2$ and therefore, these periods may be readily compared for discriminating the cycles of first and second cylinders 12 and 14.

However, in V-twin engines which drive high inertial loads, such as a high inertia implement through a belt drive, for example, it has been found that the inertia of the driven implement and/or the elasticity of the belt may impose a strong load on crankshaft 16. At certain times during running of engine 10, this strong, imposed load primarily determines the engine speed, rather than the actual firing of first and second cylinders 12 and 14. Under these circumstances, the instantaneous speed of crankshaft 16 within each period between successive ignition trigger pulses may vary from that shown in FIG. 4, and the foregoing second method of cycle of recognition may be inaccurate.

In order to compensate for this phenomenon, the piston stroke recognition method of FIG. 4 may be enhanced by concurrently measuring two series of successive "odd" and "even" periods between successive ignition trigger pulses for either first cylinder 12 or second cylinder 14. The average duration of the each of these "odd" and "even" periods may be obtained from these measurements and thereafter, the averages may be compared with one another, whereby the shorter average corresponds to periods $P_1$, and the longer average corresponds to periods $P_2$. In this manner, stroke recognition can be determined accurately even if a strong load is imposed from time to time on the engine by the implement and/or belt drive, and potential errors due to the implement inertia, engine load, and belt elasticity effect are filtered out.

Referring to FIG. 5, the steps of an exemplary version of the above-described second method are shown, with continued reference to the engine events which are depicted in FIG. 4 and described above with respect to engine 10 shown in FIG. 1. In the second method, the fuel injection system makes an arbitrary, initial assumption regarding the stroke or phase of each of the pistons in cylinders 12 and 14 upon engine startup, and injects fuel into cylinders 12 and 14 based on that initial assumption. This initial assumption for the stroke or phase of the pistons in the cylinders 12 and 14 may be either correct, in which the fuel injection system need not alter the timing of the fuel injection after the determination of piston stroke by the present method, or may be incorrect, in which the fuel injection system alters the timing of the fuel injection into cylinders 12 and 14 based upon the determination of the piston stroke by the second method.

In step 70, a $TP_2$ trigger event is detected to initiate the second method. Optionally, the method may also be initiated upon detection of a $TP_1$ trigger event, as noted above, and/or may begin upon a detection of acceleration or deceleration of crankshaft 16 of engine 10. In step 72, the time of an initial $TP_2$ is saved, and an arbitrary determination is made in step 74 as to whether an odd or even revolution of crankshaft 16 of engine 10 is occurring. In steps 76 and 78, a number of odd and even periods $P_1$ and $P_2$ are calculated by subtracting odd and even detected $TP_2$ events from previously detected $TP_2$ events, and several such periods $P_1$ and $P_2$ are added to one another in steps 80 and 82.

In step 84, a determination is made whether a predetermined number of crankshaft revolutions, corresponding to a predetermined averaging period, has been completed for periods $P_1$ and $P_2$ by detecting the total number of elapsed detected $TP_2$ events. Generally, the lesser number of crankshaft revolutions used for the averaging period allows the method to make a piston stroke recognition determination faster. However, the larger number of crankshaft revolutions used to the averaging period generally increases the accuracy of the method. One exemplary number of revolutions is 100, which provides 50 individual periods $P_1$ from which to obtain the average period $P_1$ ($AveP_1$), and 50 individual periods $P_2$ from which to obtain the average period $P_2$ ($AveP_2$). In step 86, the averages of each of the accumulated periods $P_1$ and $P_2$ are calculated by dividing each of the totals for the added periods $P_1$ and $P_2$ by the number of predetermined crankshaft revolutions in the averaging period to obtain $AveP_1$ and $AveP_2$, and the $P_1$ and $P_2$ accumulators and average count are reset.

In step 88, a determination is made as to whether $AveP_1$ is greater than $AveP_2$. If $AveP_1$ is greater than $AveP_2$, then $AveP_2$ is subtracted from $AveP_1$ in step 90 to obtain $\Delta_1$, a positive value. If $AveP_1$ is less than $AveP_2$, then $AveP_1$ is subtracted from $AveP_2$ in step 92 to obtain $\Delta_2$, again a positive value. In steps 94 or 96, $\Delta_1$ or $\Delta_2$ is compared to a threshold, which in the present method is 25 microseconds ($\mu$sec). However, the threshold may vary as desired. If $\Delta_1$ or $\Delta_2$ is greater than the threshold, then an accurate determination can be made of the stroke of the pistons in cylinders 12 and 14. Specifically, if $\Delta_1$ is greater than the threshold, then the piston in cylinder 14 was in its intake stroke during periods $P_1$, and if $\Delta_2$ is greater than the threshold, then the piston in cylinder 14 was in its power stroke during periods $P_1$. If $\Delta_1$ or $\Delta_2$ is not greater than the threshold, then an accurate determination cannot be made of the stroke of the pistons in cylinders 12 and 14, and the method is repeated until a value for $\Delta_1$ or $\Delta_2$ is obtained which is greater than the threshold.

The foregoing second method may also be used to discriminate the stroke of the piston in a single cylinder engine, in which a single ignition trigger pulse is generated for each crankshaft revolution. A first period is measured between successive trigger pulses corresponding to one crankshaft revolution. A second period is then measured between successive trigger pulses corresponding to a subsequent crankshaft revolution. Thereafter, the durations of the periods are compared with one another, with the shorter period corresponding to the power stroke of the piston and the longer period corresponding to the intake stroke of the piston. Further, the average of a number of "odd" or "even" periods between trigger pulses may be compared with one another to filter out variations in engine speed based upon engine load or other factors.

While this invention has been described as having a preferred design, the present invention can be further modified within the spirit and scope of this disclosure. This application is therefore intended to cover any variations, uses, or adaptations of the invention using its general principals. Further, this application is intended to cover such departures from the present disclosure as come within known or customary practice in the art to which this invention pertains and which fall within the limits of the appended claims.

What is claimed is:

1. In an internal combustion engine including a crankshaft and at least one cylinder having a piston reciprocating therein according to a four-stroke cycle of intake, compression, power, and exhaust, a method for determining the stroke of a piston, comprising the steps of:

generating an ignition-related event for each cylinder during each revolution of the crankshaft;

obtaining an average engine speed;

determining the duration of a plurality of periods between successive ignition-related events, each period corresponding to at least a portion of at least one of an even and odd crankshaft revolution;

obtaining an average duration for the plurality of periods; and determining the stroke of a piston by comparing the average duration for the plurality of periods to the average engine speed.

2. The method of claim 1, wherein the ignition-related event is an ignition trigger pulse generated by a magnet passing closely proximate a coil.

3. The method of claim 1, wherein said first obtaining step comprises:

determining the durations of a plurality of 360° periods between successive ignition-related events of one cylinder; and obtaining an average engine speed from the durations of the 360° periods.

4. The method of claim 1, wherein said first determining step and said second obtaining step further comprise:

determining the duration of a plurality of first periods between successive ignition-related events, each first period corresponding to at least a portion of an even crankshaft revolution;

obtaining an average duration for the plurality of first periods;

determining the duration of a plurality of second periods between successive ignition-related events, each second period corresponding to at least a portion of an odd crankshaft revolution; and obtaining an average duration for the plurality of second periods.

5. The method of claim 4, wherein said second determining step further comprises:

comparing each of the average durations for the pluralities of the first and second periods to the average engine speed to obtain first and second deviation values, respectively;

comparing the first and second deviation values to one another to obtain a deviation change; and comparing the deviation change to a threshold value.

6. The method of claim 1, wherein the engine includes a pair of cylinders arranged X° from one another, and each of the periods in the plurality corresponds to (360°−X°).

7. The method of claim 6, wherein X° is 90°.

8. In an internal combustion engine including a crankshaft and a pair of cylinders arranged X° from one another, each cylinder including a piston reciprocating therein according to a four-stroke cycle of intake, compression, power, and exhaust, a method for determining the stroke of a piston, comprising the steps of:

generating an ignition-related event for each cylinder during each crankshaft revolution;

obtaining an average engine speed;

determining the duration of at least one (360°−X°) period between successive ignition-related events of the engine cylinders; and determining the stroke of a piston by comparing the duration of the (360°−X°) period to the average engine speed.

9. The method of claim 8, wherein said first obtaining step comprises:

determining the durations of a plurality of 360° periods between successive ignition-related events of one of the cylinders; and obtaining an average engine speed from the durations of the 360° periods.

10. The method of claim 9, wherein X° is 90°.

11. The method of claim 8, wherein said first determining step further comprises:

determining the duration of a plurality of first (360°−X°) periods between successive ignition-related events, each first period corresponding to an even crankshaft revolution;

obtaining an average duration for the plurality of first periods;

determining the duration of a plurality of second (360°−X°) periods between successive ignition-related events, each second period corresponding to an odd crankshaft revolution; and obtaining an average duration for the plurality of second periods.

12. The method of claim 11, wherein said second determining step further comprises:

comparing each of the average durations for the pluralities of first and second periods to the average engine speed to obtain first and second deviation values, respectively;

comparing the first and second deviation values to one another to obtain a deviation change; and comparing the deviation change to a threshold value.

13. The method of claim 8, wherein the ignition-related event is an ignition trigger pulse generated by a magnet passing closely proximate a coil.

14. In an internal combustion engine including a crankshaft and a pair of cylinders arranged substantially X° from one another, each cylinder including a piston reciprocating therein according to a four-stroke cycle of intake, compression, power, and exhaust, a method for determining the stroke of a piston, comprising the steps of:

generating an ignition-related event for each cylinder during each crankshaft rotation;

determining the durations of a plurality of 360° periods between successive ignition-related events of one of the cylinders;

obtaining an average engine speed from the durations of the 360° periods;

determining the durations of even and odd (360°−X°) periods between successive ignition-related events of the engine cylinders;

obtaining average speeds from the durations of the even and odd (360°−X°) periods; and determining the stroke of a piston by comparing the average speed from the even and odd (360°−X°) periods to the average engine speed.

15. The method of claim 14, wherein said third determining step further comprises:

comparing each of the averages speeds of the even and odd (360°−X°) periods to the average engine speed to obtain first and second deviation values, respectively;

comparing the first and second deviation values to one another to obtain a deviation change; and comparing the deviation change to a threshold value.

16. The method of claim 14, wherein X° is 90°.

17. The method of claim 14, wherein the ignition-related event is an ignition trigger pulse generated by a magnet passing closely proximate a coil.

18. In an internal combustion engine including a crankshaft and a pair of cylinders arranged at an angle with respect to one another, each cylinder including a piston reciprocating therein according to a four-stroke cycle of intake, compression, power, and exhaust, a method for determining the stroke of a piston, comprising the steps of:

generating an ignition-related event for each of the cylinders during each crankshaft revolution;

determining the durations of a plurality of first periods between successive ignition-related events of one of the engine cylinders corresponding to odd crankshaft revolutions;

obtaining an average duration for the plurality of first periods;

determining the durations of a plurality of second periods between successive ignition-related events of the one engine cylinder corresponding to even crankshaft revolutions;

obtaining an average duration for the plurality of second periods; and comparing the average duration for the plurality of first periods with the average duration for the plurality of second periods.

19. The method of claim 18, wherein said comparing step comprises:

obtaining a difference value between the average duration for the plurality of first periods and the average duration for the plurality of second periods periods; and comparing the difference value to a threshold value.

20. The method of claim 19, wherein the ignition-related event is an ignition trigger pulse generated by a magnet passing closely proximate a coil.

* * * * *

UNITED STATES PATENT AND TRADEMARK OFFICE

CERTIFICATE OF CORRECTION

PATENT NO. : 6,874,473 B2
DATED : April 5, 2005
INVENTOR(S) : Todd L. Carpenter

It is certified that error appears in the above-identified patent and that said Letters Patent is hereby corrected as shown below:

Column 14,
Line 54, delete "periods periods" and insert -- periods --.

Signed and Sealed this

Fifth Day of July, 2005

JON W. DUDAS
*Director of the United States Patent and Trademark Office*